US008701762B2

(12) United States Patent
Shako et al.

(10) Patent No.: US 8,701,762 B2
(45) Date of Patent: Apr. 22, 2014

(54) METHOD OF DETERMINATION OF FLUID INFLUX PROFILE AND NEAR-WELLBORE SPACE PARAMETERS

(75) Inventors: Valery Vasilievich Shako, Moscow (RU); Vyacheslav Pavlovich Pimenov, Moscow (RU); Fikri John Kuchuk, Meudon (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/248,580

(22) Filed: Sep. 29, 2011

(65) Prior Publication Data

US 2012/0103600 A1 May 3, 2012

(30) Foreign Application Priority Data

Sep. 30, 2010 (RU) ..... 2010139992

(51) Int. Cl.
*E21B 47/00* (2012.01)

(52) U.S. Cl.
USPC ..... 166/250.02; 166/336

(58) Field of Classification Search
USPC ..... 166/336, 250.02; 175/72, 217, 25, 48, 175/50
See application file for complete search history.

(56) References Cited

U.S. PATENT DOCUMENTS

| | | | |
|---|---|---|---|
| 5,305,209 | A | 4/1994 | Stein et al. |
| 2007/0213963 | A1* | 9/2007 | Jalali et al. ..... 703/10 |

FOREIGN PATENT DOCUMENTS

| | | | |
|---|---|---|---|
| EP | 0176410 | A1 | 4/1986 |
| EP | 0481866 | | 4/1992 |
| EP | 2065556 | A1 | 6/2009 |
| GB | 2451560 | A1 | 2/2009 |
| RU | 2112138 | C1 | 5/1998 |
| RU | 2391501 | C2 | 6/2010 |
| RU | 2394985 | C1 | 7/2010 |
| SU | 1421858 | A1 | 9/1988 |
| WO | 9623957 | A1 | 8/1996 |
| WO | 2005035943 | A1 | 4/2005 |

OTHER PUBLICATIONS

Chekaluyk, "Oil Stratum Thermodynamics," Nedra Publishing, 1965: p. 67.

Cheremensy, "Applied Geothermics," Leningrad Nedra, 1977: pp. 181-182.

Combined Search and Examination Report of GB Application Serial No. 1116788.9 dated Nov. 24, 2011.

* cited by examiner

*Primary Examiner* — Nicole Coy
*Assistant Examiner* — Taras P Bemko

(57) ABSTRACT

Method is directed to determining a fluid influx profile and near-wellbore area parameters in multi-layered reservoirs. A bottomhole pressure in a wellbore is measured. After operation of the wellbore at a constant production rate, the production rate is changed. A bottomhole pressure is measured together with a fluid influx temperature for each productive layer. Graphs of the fluid influx temperature measured as a function of time and of a derivative of this temperature with respect to a logarithm of a time passed after the production rate is changed as a function of time are plotted. Relative production rates and skin factors of the productive layers are calculated based on these graphs.

2 Claims, 4 Drawing Sheets

METHOD OF DETERMINATION OF FLUID INFLUX PROFILE AND NEAR-WELLBORE SPACE PARAMETERS

CROSS-REFERENCE TO RELATED APPLICATION

This application claims priority to Russian Application Serial No. 2010139992 filed Sep. 30, 2010, which is incorporated herein by reference in its entirety.

FIELD OF THE DISCLOSURE

The invention relates to the area of geophysical studies of oil and gas wells, particularly, to the determination of a fluid influx profile and multi-layered reservoir near-wellbore area space parameters.

BACKGROUND OF THE DISCLOSURE

A method to determine relative production rates of productive layers of a reservoir using quasi-steady flux temperature values measured along a wellbore is described in, e.g.: Ĉeremenskij G. A. *Prikladnaja geotermija, Nedra,* 1977 p. 181. Disadvantages of the method include low accuracy in determining the layers' relative flow rate, resulting from the assumption that the Joule-Thomson effect does not depend on time and is the same for different layers. In fact, it depends on the formation pressure and specific layers pressure values.

SUMMARY OF THE DISCLOSURE

The technical result of the invention is an increased accuracy in determining wellbore parameters (influx profile, values of skin factors for separate productive layers).

The method for determining a fluid influx profile and near-wellbore area parameters comprises the following steps. A first bottomhole pressure is measured in a wellbore. The production rate is changed after a long-term operation of the wellbore at a constant production rate during a time sufficient to provide a minimum influence of the production time on the rate of the subsequent change of the temperature of the fluids flowing from the production layers into the wellbore. After changing the production rate, a second bottomhole pressure and a temperature of a fluid influx for each productive layer are measured. Graphs of the fluid influx temperature as a function of time and graphs of a derivative of this temperature with respect to a logarithm of time passed after the production rate has been changed as a function of time are plotted. Times at which the temperature derivatives become constant are determined from the plotted graphs of the derivative of the fluid influx temperature with respect to logarithm of time passed after the production rate has been changed as a function of time. Influx temperature changes corresponding to these times are also determined from the plotted graphs of the fluid influx temperature as a function of time. Relative flow rates and skin factors of the layers are calculated using the values obtained and the measured influx temperatures and the bottomhole pressures measured before and after the production rate has been changed.

DETAILED DESCRIPTION

Figure 1:
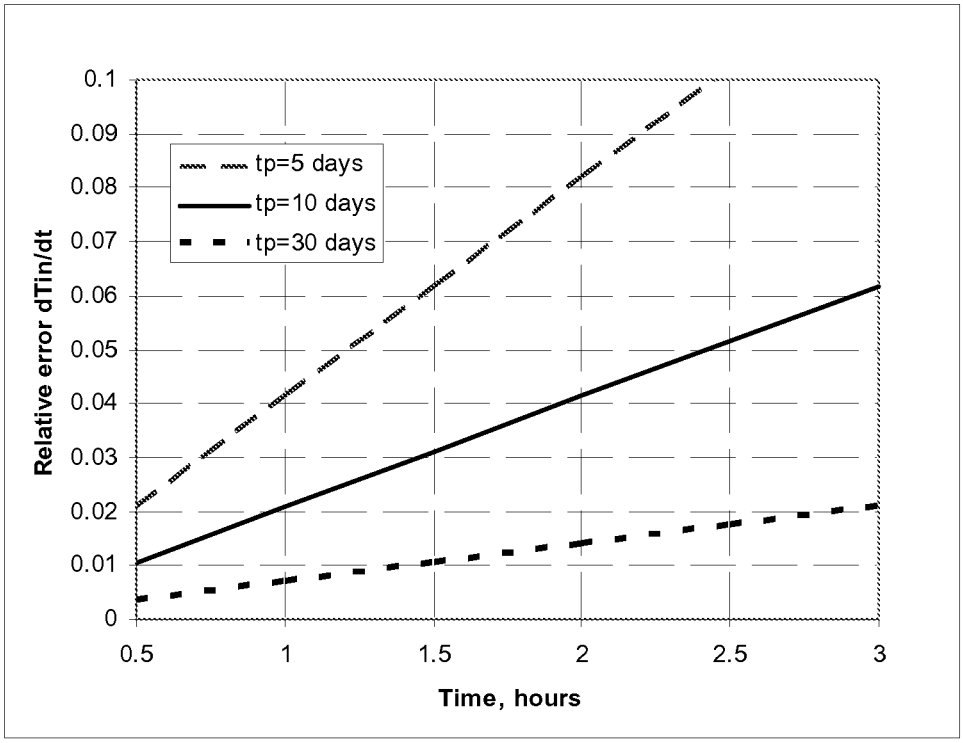
FIG. 1 shows the influence of a production time on a temperature change rate after the production rate has been changed.

The method presented herein is based on a simplified model of heat- and mass-transfer processes in a productive layer and a wellbore. Let us consider the results of applying a model that processes the measurement results of the temperature $T_{in}^{(i)}(t)$ of fluids flowing into a wellbore from two productive layers.

Pressure profiles in the productive layers are characterized by fast stabilization. After the production rate has been changed, rate of change in the temperature of the fluid flowing into the wellbore is described by the equation:

$$\frac{dT_{in}}{dt} = \frac{\varepsilon_0}{2\cdot(s+\theta)}\cdot\left[\frac{P_e-P_1}{f(t,t_{d1})}\cdot\frac{1}{(\delta_{12}\cdot t_p+t_2+t)}+\frac{P_1-P_2}{f(t,t_d)}\cdot\frac{1}{(t_2+t)}\right], \quad (1)$$

where $\epsilon_0$ is a Joule-Thomson coefficient, $P_e$ is a layer pressure, $P_1$ and $P_2$ are a first bottomhole pressure measured before and a second bottomhole pressure measured after the production rate has been changed, s is a skin factor of a productive layer, $\theta=\ln(r_e/r_w)$, $r_e$ is a drain radius, $r_w$ is a wellbore radius, t is the time passed from the moment when the production rate has been changed, $t_p$ is a production time at the first bottomhole pressure of $$P_1,\ \delta_{12} = \frac{P_e-P_1}{P_e-P_2}, \quad (2)$$

$$f(t,t_d) = \begin{cases} K & t \le t_d \\ 1 & t_d < t, \end{cases}$$

$$K = \frac{k_d}{k} = \left[1+\frac{s}{\theta_d}\right]^{-1}$$

K is a relative permeability of a near-wellbore zone, $\theta_d=\ln(r_d/r_w)$, $r_d$ is an external radius of the near-wellbore zone with a different permeability as compared with a layer far away from the wellbore. The external radius of the near-wellbore zone is determined by a set of factors, like perforation hole properties, permeability distribution in the affected zone around the wellbore and drilling incompleteness, $t_{d1}=t_1\cdot D$ and $t_{d2}=t_2\cdot D$ are certain characteristic heat-exchange times in a first productive layer and in a second productive layer, $D=(r_d/r_w)^2-1$ is a non-dimensional parameter characterizing a size of the near-wellbore zone, $$t_{1,2} = \frac{\pi\cdot r_w^2}{\chi\cdot q_{1,2}},$$

$$q_{1,2} = \frac{Q_{1,2}}{h} = \frac{2\pi\cdot k}{\mu}\cdot\frac{(P_e-P_{1,2})}{s+\theta}$$

—specific volumetric production rates before and after the production rate has been changed, $Q_{1,2}$, h and k are volumetric production rates, thickness and permeability of a layer respectively, $$\chi = \frac{c_f \cdot \rho_f}{\rho_r \cdot c_r},$$

$$\rho_r c_r = \phi \cdot \rho_f c_f + (1-\phi) \cdot \rho_m c_m,$$

$\phi$ is a layer porosity, $\rho_f c_f$ is a volumetric heat capacity of the fluid, $\rho_m c_m$ is a volumetric heat capacity of a rock matrix, $\mu$ is fluid viscosity.

According to Equation (1), if a relatively long production time $t_p$ passes before the production rate is changed, its influence on the temperature change dynamics trends towards zero. Let us evaluate this influence. For the order of magnitude $\chi \approx 0.7$, $r_w \approx 0.1$ m, and for $r_d \approx 0.3$ m q=100 [$m^3$/day]/3 m$\approx 4 \cdot 10^{-4}$ $m^3$/s, we have: $t_2 \approx 0.03$ hours, $t_{d2} \approx 0.25$ hours. If the measurement time t is t≈2÷3 hours (i.e. $t \gg t_2$, $t_{d2}$ and f(t, $t_{d2}$)=1), it is possible to evaluate what relative error is introduced into the derivative (1) value by the finite time of the production before the measurements:

$$\frac{1}{\dot{T}_{in}} \cdot \Delta(\dot{T}_{in}) = \frac{P_e - P_1}{P_1 - P_2} \cdot \frac{1}{1 + \frac{t_p}{t}} \tag{3}$$

FIG. 1 shows results of calculations using Equation (3) for $P_e$=100 Bar, $P_1$=50 Bar, $P_2$=40 Bar and $t_p$=5, 10 and 30 days. From the Figure we can see, for example, that if the time of production at a constant production rate was 10 or more days, then within t=3 hours after the change in production rate, the influence of the $t_p$ value on the influx temperature change rate will not exceed 6%.

When it is assumed that the production time $t_p$ is long enough, Equation (1) may be written as:

$$\frac{dT_{in}}{dt} \approx \frac{\varepsilon_0 \cdot (P_1 - P_2)}{2 \cdot (s + \theta)} \cdot \frac{1}{f(t, t_d)} \cdot \frac{1}{t} \tag{4}$$

From Equation (4), one can see that at a sufficiently long time $t > t_d$, $$t_d = \frac{\pi \cdot r_w^2 \cdot D}{\chi \cdot q_2} \tag{5}$$

The rate of temperature change as a function of time is described as a simple proportion:

$$\frac{dT_{in}}{d\ln t} = const.$$

Numerical modeling of the heat-exchange and mass-exchange processes in the productive layers and the production wellbore shows that the time $t = t_d$ may be identified on a graph of $$\frac{dT_{in}}{d\ln t}$$

versus time as the beginning of a constant value of the logarithmic derivative.

Assuming that dimensions of bottomhole areas in different layers are approximately equal ($D_1 \approx D_2$), then using times $t_{d,1}$ and $t_{d,2}$, relative production rates may be found for two different layers using the following equations:

$$Y = \frac{q_2 h_2}{q_1 h_1 + q_2 h_2}$$

or $$Y = \left(1 + \frac{q_1 \cdot h_1}{q_2 \cdot h_2}\right)^{-1} = \left(1 + \frac{h_1}{t_d^{(1)}} \cdot \frac{t_d^{(2)}}{h_2}\right)^{-1}$$

In general relative production rates of the second, third, etc., layers are calculated using the following equations:

$$Y_2 = \frac{q_2 h_2}{q_1 h_1 + q_2 h_2} = \left[1 + \left(\frac{h_1}{t_{d,1}}\right) \cdot \frac{t_{d,2}}{h_2}\right]^{-1}, \tag{6}$$

$$Y_3 = \frac{q_3 h_3}{q_1 h_1 + q_2 h_2 + q_3 h_3} = \left[1 + \left(\frac{h_1}{t_{d,1}} + \frac{h_2}{t_{d,2}}\right) \cdot \frac{t_{d,3}}{h_3}\right]^{-1},$$

$$Y_4 = \frac{q_4 h_4}{q_1 h_1 + q_2 h_2 + q_3 h_3 + q_4 h_4} = \left[1 + \left(\frac{h_1}{t_{d,1}} + \frac{h_2}{t_{d,2}} + \frac{h_3}{t_{d,3}}\right) \cdot \frac{t_{d,4}}{h_4}\right]^{-1},$$

etc.

such that for an i+1 layer a relative production rate is $$Y_{i+1} = \left[1 + \left(\sum_{k=1}^{i} \frac{h_k}{t_{d,k}}\right) \cdot \frac{t_{d,i+1}}{h_{i+1}}\right]^{-1}$$

where $Y_{i+1}$ is a relative production rate of (i+1) layer, i=1, 2 . . . , $_1$ $h_k$ is a thickness of a first k layer, k=1, 2 . . . i, $t_{d,k}$ is a time at which a temperature derivative becomes constant on a second graph of the temperature derivative with respect to a logarithm of time passed after the production rate has been changed as a function of time plotted for the first k layer, $h_{i+1}$ is a thickness of an (i+1) layer, $t_{d,i+1}$ is a time at which a temperature derivative becomes constant on a second graph of the temperature derivative with respect to a logarithm of time passed after the production rate has been changed as a function of time plotted for the (i+1) layer.

Equation (1) is obtained for a cylindrically symmetrical flow in a layer and a near-wellbore zone, which has an external radius $r_d$. The temperature distribution in the-near-wellbore zone is different from the temperature distribution away from the wellbore. After the production rate has been changed, this temperature distribution is carried over into the well by the fluid flow which results in the fact that the nature of the $T_{in}(t)$ dependence at short times (after the production rate has been changed) differs from the $T_{in}(t)$ dependence observed at long ($t > t_d$) time values. From Equation (7), one can see that with an accuracy to $\chi$ coefficient a volume of the produced fluid which is required for the transition to a new type of the dependence of the fluid influx temperature $T_{in}(t)$ versus time is determined by a volume of the near-wellbore zone:

$$t_d \cdot q_2 = \frac{1}{\chi} \cdot \pi \cdot (r_d^2 - r_w^2) \tag{7}$$

In case of a perforated wellbore, there always is a "near-wellbore" zone (regardless of the distribution of permeabilities) in which the temperature distribution is different from the temperature distribution in a layer away from the wellbore. This is an area where the fluid flow is not symmetrical and the size of this area depends on a length of perforation tunnels ($L_p$):

$$D_p \approx \left(\frac{r_w + L_p}{r_w}\right)^2 - 1. \tag{8}$$

Assuming that lengths of the perforation tunnels in different productive layers are approximately equal ($D_{p1} \approx D_{p2}$), then relative production rates of the layers are also determined by Equation (6). Equation (8) may be updated by introducing a numerical coefficient of about 1.5-2.0, the value of which may be determined from a comparison with numerical calculations or field data.

To determine a skin factor s of a layer, a change in temperature $\Delta T_d$ of a fluid flowing into the wellbore during the time from the beginning of the production rate change until a time $t_d$ is used:

$$\Delta T_d = \int_0^{t_d} \frac{dT_{in}}{dt} \cdot dt. \tag{9}$$

Using Equation (4), we find:

$$\Delta T_d = c \cdot \varepsilon_0 \cdot (P_1 - P_2) \cdot \frac{s + \theta_d}{s + \theta}, \tag{10}$$

where $\Delta T_d$ is the change of the influx temperature by the time $t = t_d$, $(P_1 - P_2)$ is a difference between the first bottomhole pressure measured before the production rate has been changed and the second bottomhole pressure achieved in the wellbore several hours after the wellbore production rate has been changed. Whereas Equation (4) does not consider the influence of the end layer pressure field tuning rate, Equation (10) includes a non-dimensional coefficient c (approximately equal to one), the value of which is updated by comparing with the numerical modeling results.

According to (10), the skin factor s of a layer is calculated using the equations below.

$$s = \frac{\psi \cdot \theta - \theta_d}{1 - \psi} \tag{11}$$

$$\text{where } \psi = \frac{\Delta T_d}{c \cdot \varepsilon_0 \cdot (P_1 - P_2)}$$

Therefore the determination of the influx profile and skin factors of the productive layers includes the following steps:

1. A first bottomhole pressure is measured. A wellbore is operated at a constant production rate for a long time (from 5 to 30 days depending on the planned duration and measurement accuracy requirements).

2. The production rate is changed and a second bottomhole pressure and temperature $T_{in}^{(i)}(t)$ of fluids flowing into the wellbore from different productive layers are measured.

3. Derivatives from the measured fluid influx temperatures $dT_{in}^{(i)}/d\ln t$ are calculated and relevant graphs are plotted.

4. From these graphs, values of $t_{d,i}$ are found as time moments starting from at which the derivatives $dT_{in}^{(i)}/d\ln t$ become constant and using Equation (6), relative production rates of the layers are calculated.

5. From graphs $T_{in}^{(i)}(t)$ values of temperature changes $\Delta T_d^{(i)}$ at $t_{d,i}$ time moments are determined and using Equation (11), skin factors of the productive layers are found.

The temperature of fluids flowing into the wellbore from the productive layers may be measured using, for example, the apparatus described in WO 96/23957. The possibility of determining an influx profile and skin factors of productive layers using the method described herein was checked on synthetic examples prepared by using a numerical simulator of the producing wellbore. The simulator simulates an unsteady pressure field in the wellbore-layers system, a non-isothermal flow of compressible fluids in a heterogeneous porous medium, mixing of the flows in the wellbore, and wellbore-layer heat exchange, etc.

Figure 2:
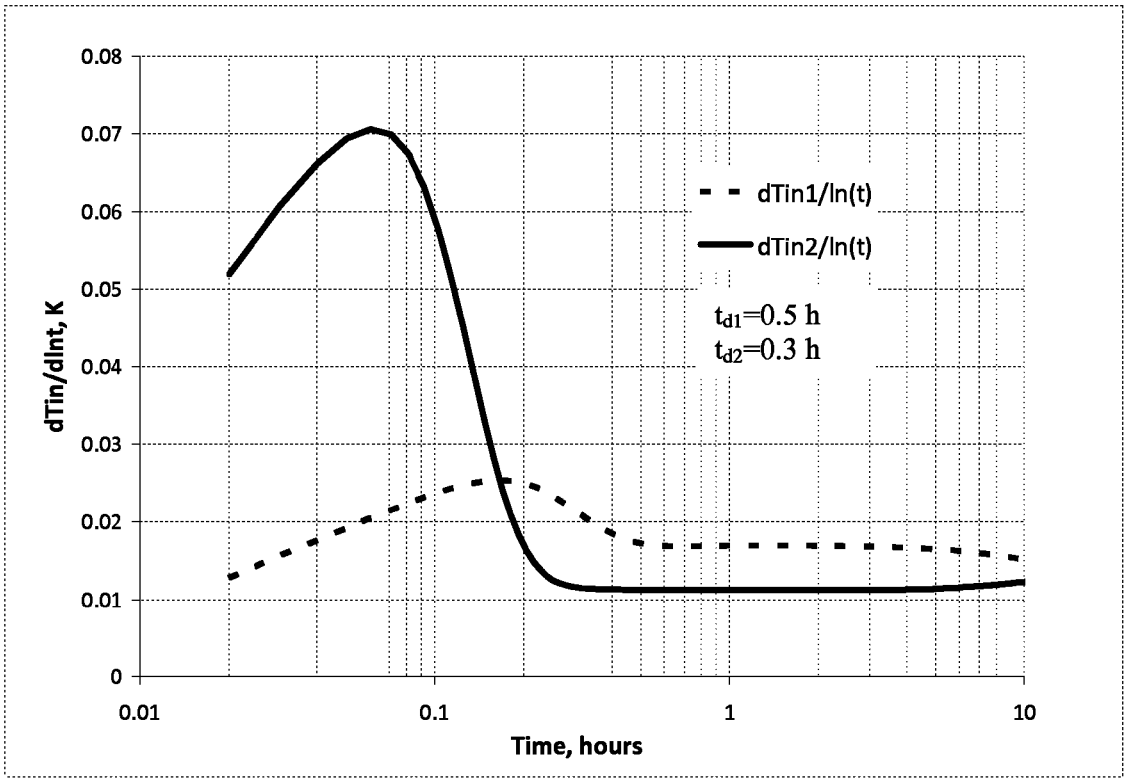
FIG. 2 shows changes in derivatives of temperature of fluid influxes from different productive layers with respect to a logarithm of a time passed after a production rate has changed. Times $t_{d,1}$ and $t_{d,2}$ are marked after the temperature derivatives become constant (these values are used to calculate relative production rates of the productive layers)
Figure 3:
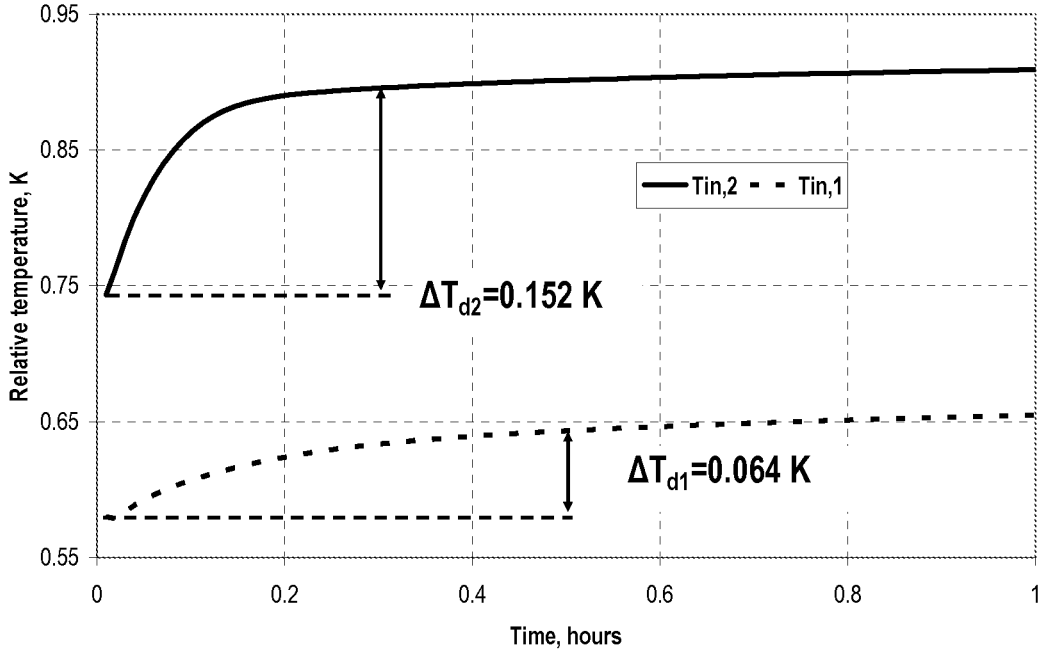
FIG. 3 shows graphs of an influx temperature as a function of time and determination of the influx temperature changes $\Delta T_{d,1}$ and $\Delta T_{d,2}$ (by the times $t_{d,1}$ and $t_{d,2}$) used to calculate skin factors of the productive layers for a two-layer wellbore model.
Figure 4:
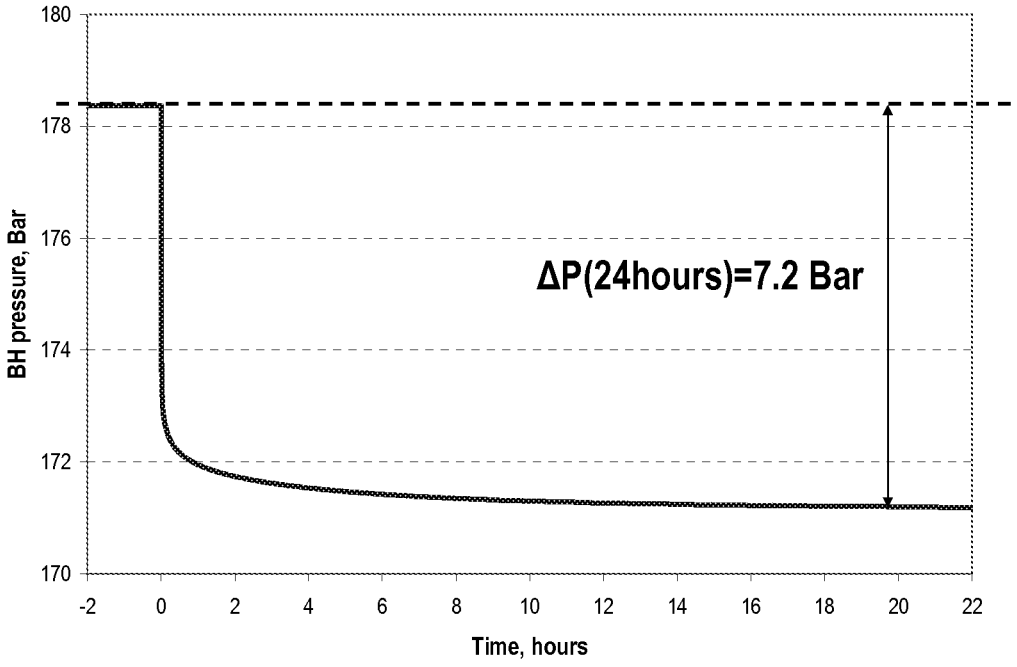
FIG. 4 shows a bottomhole pressure as a function of time passed after a change in production rate.

FIG. 2-4 shows the results of the calculation for the following two-layer model:

$k_1$=100 mD, $s_1$=0.5, $h_1$=4 m $k_2$=500 mD, $s_2$=7, $h_2$=6 m

The production time at a production rate of $Q_1$=300 $m^3$/day is $t_p$=2000 hours; $Q_2$=400 $m^3$/day. FIG. 4 shows that in this case the wellbore pressure continues to change considerably even after 24 hours. FIG. 2 provides graphs of the derivatives of the influx temperature $T_{in,1}$ and $T_{in,2}$ with respect to the logarithm of time passed after the wellbore production rate has been changed. From the Figure it can be seen that the derivatives dT/dint become constant respectively, at $t_{d,1}$=0.5 hours and $t_{d,2}$=0.3 hours. Using these values, a relative production rate for an upper layer of 0.72 is found, which is close to the true value (0.77). From the graph of influx temperature as a function of time (FIG. 3), $\Delta T_{d,1}$=0.064K and $\Delta T_{d,2}$=0.152K are found. The layer skin factors calculated using the obtained values of $\Delta T_{d,1}$ and $\Delta T_{d,2}$ and Equation (11) at c=1.1 differ from the true values of skin factors by less than 20%.

What is claimed:

1. A method for determining a fluid influx profile and near-wellbore area parameters comprising:

measuring a first bottomhole pressure in a wellbore, operating the wellbore at a constant production rate during a time sufficient to provide a minimum influence of a production time on a rate of a subsequent change of a temperature of the fluids flowing from production layers into a wellbore, changing the production rate, measuring a second bottomhole pressure after changing the production rate, measuring for each productive layer a fluid influx temperature as a function of time after changing the production rate, determining for each productive layer a derivative of the measured fluid influx temperature with respect to a logarithm of time, calculating relative production rates of the productive layers as $$Y_{i+1} = \left[1 + \left(\sum_{k=1}^{i} \frac{h_k}{t_{d,k}}\right) \cdot \frac{t_{d,i+1}}{h_{i+1}}\right]^{-1}$$

where $Y_{i+1}$ is a relative production rate of (i+1) layer, i=1, 2 . . . , $h_k$ is a thickness of a k layer, $t_{d,k}$ is a time at which the temperature derivative becomes constant for the k layer, $h_{i+1}$ is a thickness of an (i+1) layer, $t_{d,i+1}$ is a time at which the temperature derivative becomes constant for the (i+1) layer, determining for each productive layer a fluid influx temperature change corresponding to the time at which the temperature derivative becomes constant, and calculating skin factors of the productive layers as $$s = \frac{\psi \cdot \theta - \theta_d}{1 - \psi}$$

where $$\psi = \frac{\Delta T_d}{c \cdot \varepsilon_0 \cdot (P_1 - P_2)}$$

$\theta = \ln(r_e/r_w)$, $r_e$ is a drain radius, $r_w$ is a radius of the wellbore, $\theta_d = \ln(r_d/r_w)$ $r_d$ is an external radius of the near-wellbore area, c is a non-dimensional coefficient, $\epsilon_0$ is a Joule-Thomson coefficient, $P_1$ is the first bottomhole pressure in the wellbore measured before the production rate has been changed, $P_2$ is the second bottomhole pressure in the wellbore measured after the production rate has been changed, $\Delta T_d$ is a fluid influx temperature change corresponding to the time at which the temperature derivative of the measured fluid influx temperature becomes constant.

2. A method of claim 1 wherein the wellbore is operated at the constant production rate from 5 to 30 days before changing the production rate.

* * * * *